United States Patent [19]

Dirks

[11] Patent Number: 4,874,345

[45] Date of Patent: Oct. 17, 1989

[54] DOLL WITH CHANGEABLE HAIR PIECE

[76] Inventor: Clara Dirks, 1412 S. Quincy St., Arlington, Va. 22204

[21] Appl. No.: 277,652

[22] Filed: Nov. 29, 1988

[51] Int. Cl.[4] ..... A63H 3/44

[52] U.S. Cl. ..... 446/394; 446/319

[58] Field of Search ..... 446/394, 319, 296, 372, 446/100; 132/54, 53

[56] References Cited

U.S. PATENT DOCUMENTS

| | | | |
|---|---|---|---|
| 1,490,479 | 8/1924 | Noel | 446/394 X |
| 2,253,635 | 8/1941 | Mann | 446/394 |
| 3,225,489 | 12/1965 | Ryan | 446/394 |
| 3,765,123 | 10/1973 | Terzian | 446/394 |
| 4,070,790 | 1/1978 | Strongin et al. | 446/394 |
| 4,625,739 | 12/1986 | Hamazaki | 132/54 |

FOREIGN PATENT DOCUMENTS

| | | | |
|---|---|---|---|
| 2537880 | 6/1984 | France | 446/394 |
| 809054 | 2/1959 | United Kingdom | 446/394 |
| 997266 | 7/1965 | United Kingdom | 446/394 |

*Primary Examiner*—Mickey Yu

*Attorney, Agent, or Firm*—Shlesinger & Myers

[57] ABSTRACT

A doll with a doll head for releasably mounting changeable hair piece thereon. The hair piece includes a suction cup portion which snaps on the doll's head and maintains a tight fit such that the cup has to be peeled off in order to remove the hair piece from the head. The hair piece includes a fastening element for attaching an auxiliary hair piece thereto.

2 Claims, 2 Drawing Sheets

DOLL WITH CHANGEABLE HAIR PIECE

FIELD AND HISTORICAL BACKGROUND OF THE INVENTION

The present invention is directed to a doll with changeable hair piece, and more particularly to a doll head with a changeable hair piece which is suction-snapped onto the doll's head.

Conventional dolls are generally provided with wigs or hair pieces formed of artificial hair which normally is permanently mounted to the doll head, for example, by rooting. Other types of conventional dolls include non-permanent type of wigs or hair pieces which could be entirely removed and replaced with another hair piece with different hair color or style. The construction and arrangement of such changeable hair pieces has been such, however, that the hair pieces fail to remain tightly positioned on the doll's head after mounting, or are difficult to mount in a desired position.

In the mannequin type of dolls available today, the trend has been to imitate the styles and fashions in use by adults and teenagers. Thus, the mannequins are dressed with clothing, accessories, hair styles and the like, which are authentic simulations of such items currently in fashion. Among these items, the use of different hair pieces, particularly artificial hair pieces, such as falls, chignons, puffs of curls or the like, which are attached to the natural hair of women to supplement and build up the hairdo, is especially popular. However, the use of such supplemental hair pieces have not been successful for dolls and the like for the reason that the attachment of the hair pieces to the doll head is not practical or possible since the hair pieces are difficult to mount on the doll's head.

The representative examples of conventional dolls are disclosed in U.S. Pat. Nos. 3,225,489; 3,765,123; and 4,070,790. In addition, British Nos. 809,554 and 997,266, and French No. 2,537,880 disclose similar types of dolls.

Therefore, there is need in the art for a doll in which different hair pieces can be easily snapped-on to the doll's head, and which maintain a tight fit such that the hair piece has to be peeled off in order to release it from the doll's head.

OBJECTS AND SUMMARY OF THE INvENTION

The principal object of the present invention is to provide a doll with a changeable hair piece.

One object of the present is to provide a doll with a changeable hair piece wherein the hair piece includes a suction cup which snaps onto the doll's head and maintains a tight fit.

Another object of the present invention is to provide a doll with a changeable hair piece wherein the hair piece is easily mounted and removed from the doll's head.

Still another object of the present invention is to provide a doll with a changeable hair piece wherein a ponytail type of hair piece may be removably mounted on the wig or hair piece fitted on the doll's head.

Yet another object of the present invention is to provide a doll with a changeable hair piece which is simple in construction and easy to use.

In summary, the main object of the present invention is to provide a doll with a changeable hair piece wherein the hair piece includes a suction cup which is easily snapped on and off the doll's head and maintains a tight fit thereon.

BRIEF DESCRIPTION OF THE DRAWINGS

The above and other objects and advantages and novel features of the present invention will be come apparent from the following detailed description of the preferred embodiment of the invention illustrated in the accompanying drawings, in which.

DETAILED DESCRIPTION OF THE INVENTION

Figure 1:
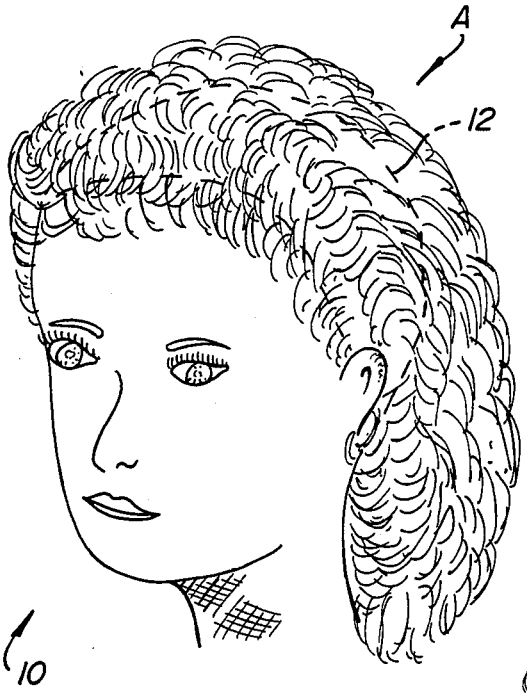
FIG. 1 is a perspective view of the doll head with the hair piece mounted thereon.

Referring in detail to the drawings, there is generally indicated in FIG. 1 a doll head A with a wig or hair piece B mounted thereon. The doll head A includes a face portion 10 with facial features, such as nose, eyes, eyelashes, eyebrows, etc., and a crown portion 12.

Doll head A is hollow and mounted on a neck portion 13, and is molded in the conventional manner from a plastic material, such as polyvinyl chloride, which is preferably flexible. It should be noted, however, that the doll head A may be made of other conventional materials, and may be made solid, if desired.

Figure 2:
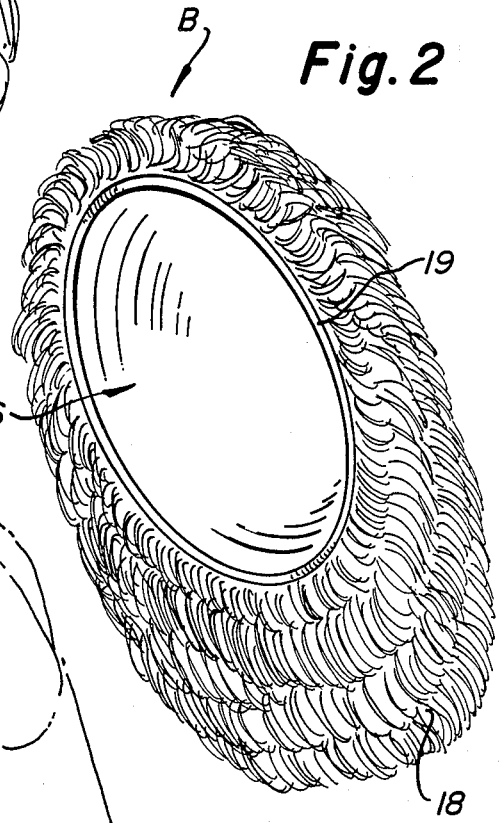
FIG. 2 is a perspective elevational view of the hair piece showing the suction cup.
Figure 3:
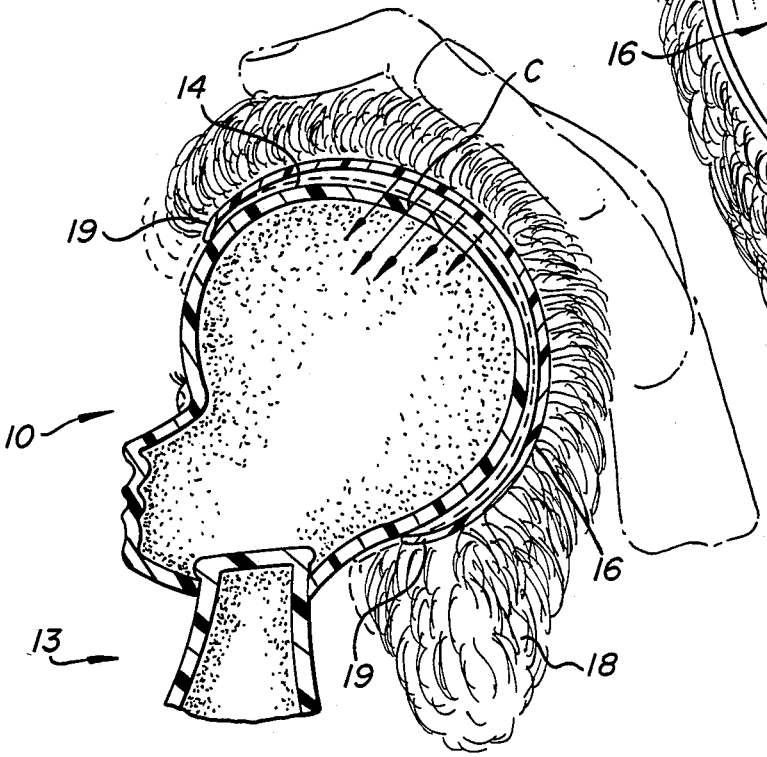
FIG. 3 is a longitudinal sectional view of FIG. 1 showing the doll head with the hair piece mounted thereon in broken lines.
Figure 5:
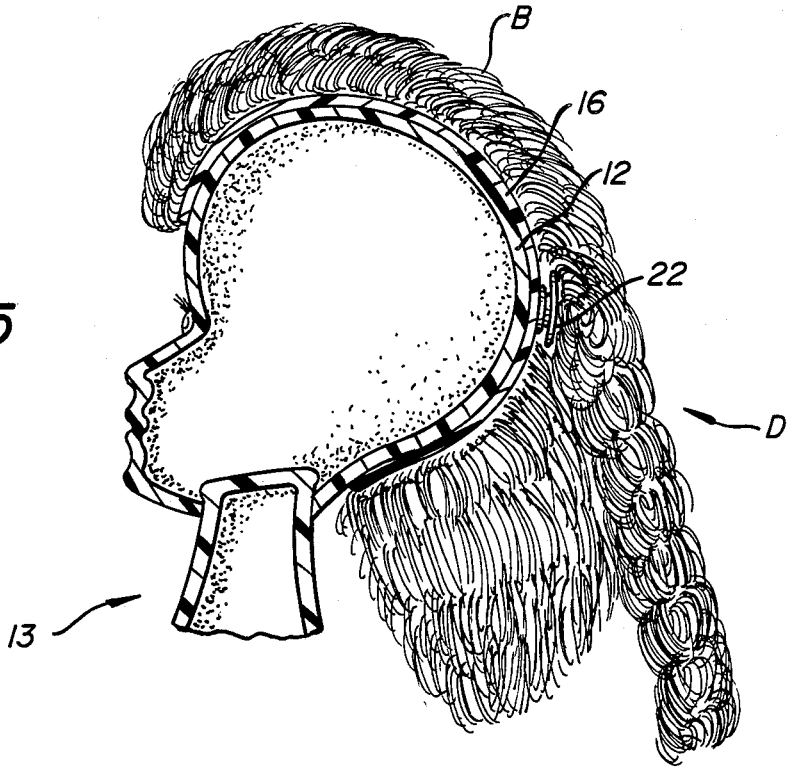
FIG. 5 is a longitudinal sectional view of another embodiment of the invention showing the doll head with the hair piece and ponytail mounted thereon.

The crown portion 12 includes surface 14 which is smooth to receive the hair piece B. As best shown in FIG. 2, hair piece B includes a suction cup portion 16 and artificial or natural hair strands 18 mounted thereon. The cup portion 16 is made of a flexible plastic like material which is supple yet capable of holding a shape and including an inwardly curved marginal edge 19 of a greater curvature than the curvature of the central portion of cup 16. The example of the material for making the suction cup 16 include epoxy resin, synthetic polymers, etc. The hair strands 18 may be artificial or natural hair of different colors, such as brown, blonde, black, to impart natural look of a human head. The dimensions of cup portion 16 are such that when snap-fitted over the doll head A, it substantially covers the crown portion 12. As shown in FIG. 3, when hair piece B is placed over the crown portion 12 and a pressure is applied indicated by arrows C, suction cup portion 16 stretches over the crown portion 12 and is held in place due to the suction pressure (FIG. 5).

Figure 4:
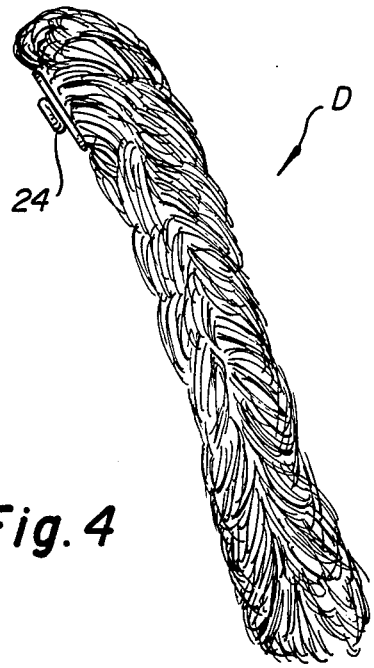
FIG. 4 is showing a ponytail type of hair piece which may be attached to the hair piece.
Figure 6:
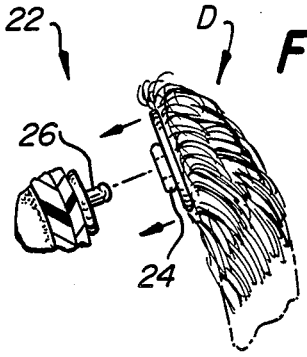
FIGS. 6 and 7 partially show the doll head and ponytail illustrating means for attaching the ponytail to the hair piece.
Figure 7:
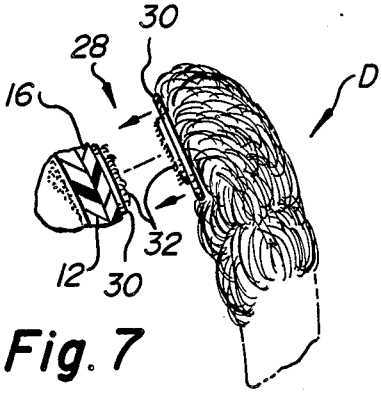

The hair piece provided with the doll may be of any of the many styles presently used in fashion, and may, for example be styled as ponytails, puffs of curls, chignons, pigtails, or the like. In an alternative embodiment, shown in FIG. 5, the hair piece B may be provided with conventional snap-on type of fastening means 22 to attach an auxiliary hair piece, for example, ponytail D (FIG. 4), to the wig or hair piece B. FIG. 6 shows a snap-on type of fastening means 22, including fastener 24 and press-stud 26 secured to ponytail D and hair piece B, respectively. FIG. 7 shows a Velcro fastening element 28 including fabric strips 30 with hook engaging means 32 in the form of an array of plastic loops.

As can be seen from the above, the doll with a changeable hair piece of the present invention provides simple and relatively inexpensive structure for readily varying the hairdo of a doll. The suction cup 16 of the hair piece B, in addition to imparting overall structure, provides a simple yet practical way of mounting the hair piece B on the doll head A. The hair piece B can be easily removed by peeling off suction cup portion 16 starting at any portion of the periphery thereof.

The doll of the present invention is particularly advantageous in that no metal parts are necessary and there is no need to provide any type of openings in the doll head. In addition, the invention shows a further improvement in that the hair piece B maintains a tight fit on the doll head A such that it grips it well and remains in the right position even when play-handled by children and the like, until it is peeled off in order to release it from the doll head.

While this invention has been described as having a preferred design, it is understood that it is capable of further modifications, uses and/or adaptations of the invention and following in general the principle of the invention and including such departures from the present disclosure as come within known or customary practice in the art to which the invention pertains, and may be applied to the central features hereinbefore set forth, and fall within the scope of the invention or the limits of the appended claims.

What is claimed is:

1. A doll's head with changeable hair piece, comprising:

(a) a hair piece having front, rear sides and central portion and having a top side and an underside and having hair mounted only on the entire top side thereof from front to rear and from side to side and the central portion;

(b) a head including a convex crown portion having front, rear sides and a central portion and a face portion;

(c) said hair piece including a single stretchable, flexible, snap-fit concave suction cup having front, rear sides and central portion and having its front, rear sides and central portion coextensive with said front, rear sides and central portion of said top side and having a dimension substantially equal to said hair piece and said crown and forming when stretched and snapped onto said crown a vacuum above substantially the entire crown including said front, rear sides and central portion to resist efforts to remove said hair piece from said crown when said hair on said hair piece is grasped;

(d) said suction cup having a continuously curved central concavity cooperating with the continuous convexity of said head and including a peelable inwardly curved concave elastic peripheral edge of a greater curvature than the curvature of said curved central concavity of said cup and having its concavity continuous with the concavity of the cup so that said edge may be easily peeled back so as to break the suction between the cup and said crown to release said cup from said crown; and (e) said suction cup having a normal dimension slightly less than said crown so that said cup when applied to said doll's head stretches outwardly over and against said entire crown to produce suction pressure over the entire crown front to rear sides and central portion.

2. The doll's head of claim 1, wherein:

(a) on said top side at the rear thereof is secured a fastening means; and (b) an auxiliary hair piece having means cooperating with said fastening means for securing said auxiliary hair piece to said hair piece.

* * * * *